US006843041B2

(12) United States Patent
Focke et al.

(10) Patent No.: US 6,843,041 B2
(45) Date of Patent: Jan. 18, 2005

(54) METHOD AND DEVICE FOR PRODUCING FLAP CASES COMPRISING A CLOSING ACCESSORY

(75) Inventors: Heinz Focke, Verden (DE); Martin Stiller, Verden (DE)

(73) Assignee: Focke & Co. (GmbH & Co.), Verden (DE)

( * ) Notice: Subject to any disclaimer, the term of this patent is extended or adjusted under 35 U.S.C. 154(b) by 0 days.

(21) Appl. No.: 10/332,077

(22) PCT Filed: Jun. 20, 2001

(86) PCT No.: PCT/EP01/06953

§ 371 (c)(1),
(2), (4) Date: Apr. 8, 2003

(87) PCT Pub. No.: WO02/02306

PCT Pub. Date: Jan. 10, 2002

(65) Prior Publication Data

US 2003/0153446 A1 Aug. 14, 2003

(30) Foreign Application Priority Data

Jul. 3, 2000 (DE) ..... 100 31 319

(51) Int. Cl.[7] ..... B65B 7/16
(52) U.S. Cl. ..... 53/484; 53/228; 53/234
(58) Field of Search ..... 493/51, 52, 910, 493/911; 53/228, 234, 468, 484

(56) References Cited

U.S. PATENT DOCUMENTS

| | | | | | |
|---|---|---|---|---|---|
| 3,956,865 | A | * | 5/1976 | Schmermund | 53/456 |
| 4,392,338 | A | * | 7/1983 | Fox | 53/462 |
| 4,487,596 | A | | 12/1984 | Livens et al. | |
| 5,435,440 | A | | 7/1995 | Focke et al. | |
| 5,462,223 | A | * | 10/1995 | Focke et al. | 229/160.1 |
| 5,613,932 | A | | 3/1997 | Focke et al. | |
| 6,113,525 | A | * | 9/2000 | Waechter | 493/183 |
| 6,195,959 | B1 | * | 3/2001 | Tisma | 53/138.1 |

FOREIGN PATENT DOCUMENTS

| | | |
|---|---|---|
| EP | 0 433 657 | 6/1991 |
| EP | 0 434 962 | 7/1991 |

* cited by examiner

*Primary Examiner*—Eugene Kim
(74) *Attorney, Agent, or Firm*—Sughrue Mion, PLLC

(57) ABSTRACT

Hinge-lid boxes for cigarettes, comprising a box part (12) and lid (13), are frequently fitted with a closure aid for the lid (13). Said closure aid comprises interlocking elements which can be brought into engagement with one another, namely a lid inner tab (16), on the one hand, and a collar front wall (17), on the other hand. In order to ensure operativeness as soon as the pack is used, it is ensured that the closure aid is already in engagement when the pack is completed, i.e. before it is used for the first time. For this purpose, the lid (13) is partially opened after being substantially completed and is then moved into the closed position again thereby ensuring engagement of the closing elements.

16 Claims, 7 Drawing Sheets

17
14
16
13
22
46
28
29
15
12
10

METHOD AND DEVICE FOR PRODUCING FLAP CASES COMPRISING A CLOSING ACCESSORY

BACKGROUND OF THE INVENTION

The invention relates to a method for producing (cigarette) packs of the hinge-lid box type, comprising a box part, lid and collar, the lid being retained in the closed position by a closure aid comprising interlocking elements, namely by interlocking elements of the lid, on the one hand, and of the box part or of the collar, on the other hand. Furthermore, the invention relates to a device for carrying out the method.

In the case of cigarette packs of the hinge-lid box type, a closure aid for the lid is desirable, in particular in the case of hinge-lid boxes having rounded or bevelled pack edges—round edges—or an octagonal pack.

A closure aid according to EP 0 434 962 has proven particularly advantageous. In the case of this known design, a lid inner tab, which is arranged on the inside of a lid front wall, is configured in a special manner to the effect that border regions of the lid inner tab interlock with the collar in the closed position. Specifically, there is a form-fitting engagement between the lid inner tab and collar in the region of lateral, upright webs which bound a recess which is customary in the region of a collar front wall.

In the case of a closure aid of the abovementioned design or of another, similar design with alternating interlocking elements, it has been established that interlocking is not always ensured after the pack has been used for the first time.

SUMMARY OF THE INVENTION

The invention is therefore based on the object of proposing measures which ensure reliable interlocking of the closure aid when the hinge-lid box is used.

In order to achieve this object, the invention proposes that the interlocking elements, which are separated from one another during manufacturing of the pack, in particular the lid inner tabs, on the one hand, and the collar front wall, on the other hand, are brought into an interlocking position immediately before or after the pack is completed, and the pack is completed in this interlocking position.

The invention is based on the finding that the closure aid is frequently not effective because the elements entering into alternate engagement with one another are separated from one another or are disengaged during production of the pack. A certain deformation of the closure aid is then required in order to bring it into effect. This risk does not exist when the method according to the invention is used, since the closure aid is already retained in the effective position after the pack is completed and until the latter is used.

A method according to the invention is advantageous in which the pack is largely completed, namely, in particular, the lid, but without those parts of the lid which are connected to one another, in particular the inner and outer lid side tabs, being bonded. In this state, the lid can still be deformed to a great extent, and, according to the invention, can be partially opened and then closed again, in which case, during the closing operation, the interlocking elements are brought into engagement with one another, i.e., in particular, the lid inner tab is brought into engagement with the webs of the collar front wall. The lid is then completed by folding over the (outer) lid side tabs and connecting them to the (already folded) inner lid side tabs.

A device for carrying out the method accordingly comprises elements for partially opening the lid and for closing it again, with pressure elements acting on the lid and box part in order to deform the interlocking elements in such a manner that the interlocking elements enter into an engaged position during the closing process of the lid.

BRIEF DESCRIPTION OF THE DRAWINGS

Further features of the invention will be explained in greater detail below with reference to the drawings, in which.

DETAILED DESCRIPTION OF THE DRAWINGS

Figure 1:
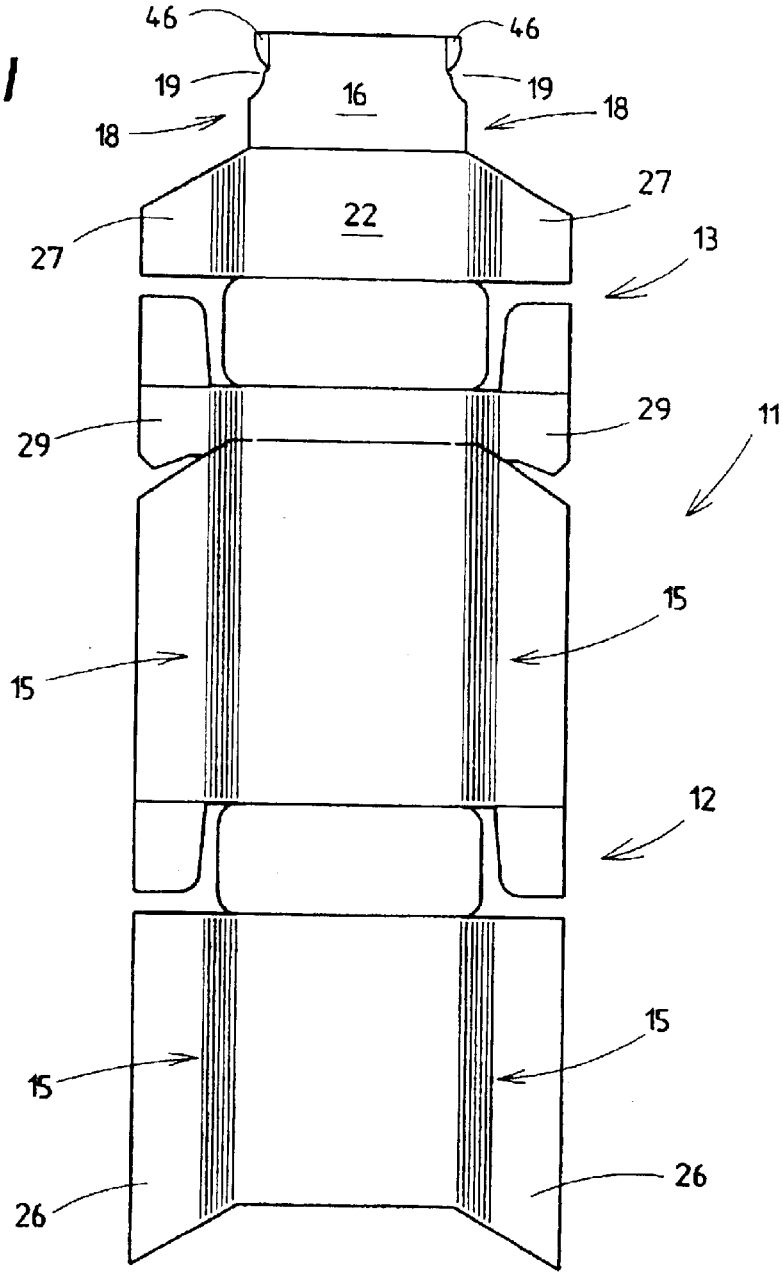
FIG. 1 shows a spread-out blank for a hinge-lid box having round edges.

The drawings are concerned with a preferred exemplary embodiment of a (cigarette) pack 10 of the hinge-lid type. The pack 10 comprises a blank 11 consisting of thin cardboard, which forms a (lower) box part 12 and a lid 13. This type of pack 10 also includes a collar 14 comprising a separate blank, likewise consisting of thin cardboard. The pack 10 is designed with rounded, upright pack edges 15 and is consequently a round-edged pack. The blank 11 and the pack manufactured therefrom are otherwise designed in accordance with the provisions of EP 0 434 962.

The same is also true for a closure aid, i.e. a device on the pack 10 ensuring the closed position of the lid 13. The closure aid comprises interlocking elements on the lid 13, on the one hand, and on the box part 12 or on the collar 14, on the other hand. In the closed position, these interlocking elements come into engagement with one another by means of the closing process of the lid 13 and thus ensure an exact closed position.

In the case of the present exemplary embodiment—as in EP 0 434 062—a lid inner tab 16, on the one hand, and the collar 14 or its collar front wall 17, on the other hand, are the interlocking elements. The lid inner tab 16 bears, by being folded over, against the inside of a lid front wall 22 and is connected to the latter by bonding. In the region of each of the side borders 18, the lid inner tab 16 has a recess 19 or punched-out area. The two recesses interact with a predetermined, customary contour of the collar front wall 17. A central depression 20 produces lateral webs 21 having upwardly diverging edges. The two side borders 18 of the lid inner tab 16 interact with said edges in such a manner that a free or upper region of the webs 21 passes under the lateral region of the lid inner tab 16 and is thus fixed in a clamping and interlocking manner. In the process, a clamping lug 46, which is bounded by the recess 19, on the border of the lid inner tab 16 bears against the inside of the respective web 21. The gluing regions for fixing the lid inner tab 16 are positioned in such a manner that the region of the side borders 18 remains free and makes possible the interlocking engagement with the collar 14. Before the blank 11 is introduced into the folding turret 23 or in the region thereof, the closure aid is deformed, specifically by raising the clamping lug 46 into an oblique position, so that the process of inserting it together with the collar and the webs 21 is made easier.

During manufacturing of the pack 10 the procedure takes place in such a manner that the blank 11 is partially folded in a folding turret 23 and is filled by feeding in a cigarette block 24 as pack contents. The collar 14, which is folded in U-shape, is conveyed in the radial direction by means of this cigarette block 24 into the folding turret 23 or into a prefolded blank 11. The lid or the front part thereof is then folded onto the cigarette block 24 and the collar 14. As a result, the lid inner tab 16 and collar front wall 17 bear against each other or rest on each other without alternate interlocking.

In this form, the pack 10 is ejected in the radial direction out of the folding turret 23 into a following pack conveyor path 25. In the region thereof, the last folding steps are carried out, namely the horizontally and laterally directed side tabs 26 and lid side tabs 27 are folded over in order to form side walls of the pack 10. The side tabs 26 and lid side tabs 27 are provided with glue before being folded over.

The manufacturing or folding process for the pack 10 now has to be finished in such a manner that in the finished pack the interlocking elements of the closure aid, i.e. the webs 21 of the collar 14 and the clamping lugs 46 of the lid inner tab 16, are in engagement. The procedure here is such that the entirely or partially completed pack 10 is slightly opened again by corresponding displacement of the lid 13 or of the lid front wall 22, and engagement of the interlocking elements is achieved by displacement into the closed position.

Figure 2:
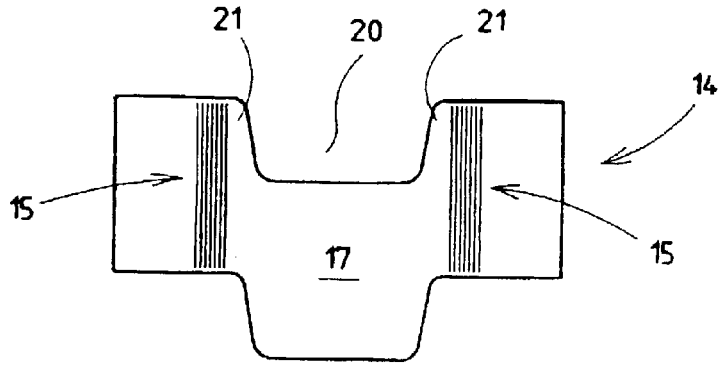
FIG. 2 shows a spread-out blank for a collar.

In a longitudinal or vertical section through the pack in the region of the lid 13, FIG. 1 shows the initial state when the lid inner tab 16 and collar front wall 17 bear against each other without interlocking engagement, specifically after leaving the folding turret 23. The lid 13 is then displaced in the opening direction while maintaining contact against the collar 14 (FIG. 2). This results in a slight change in angle between the lid front wall 22 and adjoining end wall 28. This deformation is possible because the outer lid side tabs 27 have not yet been connected to the inner lid side tabs 29.

In the position according to FIG. 2, owing to the displacement of the lid front wall 22 there is a free region of the side border 18, namely as far as the recess 19, outside the region of the collar 14 or outside the depression 20 in the region of the collar front wall 17 (FIG. 2). In this position, an effect arising from restoring forces in the packaging material, namely in the lid inner tab 16, is shown to advantage. The folding process of the lid inner tab 16 means that restoring forces are still effective therein, said restoring forces bringing about a slight raising of a lateral region of the lid inner tab 16, namely, in particular, in the region of the clamping lug 46. If now, according to FIG. 3, the lid is again pushed back into the closed position, an engagement of the lid inner tab 16 with the collar front wall 17, namely with the webs 21, is automatically produced, specifically in accordance with the illustration in EP 0 434 962. The pack 10 can now be completed.

Elements are fitted in the region of the pack conveyor path 25, which elements carry out the described measures during the (continuous) transportation of the largely completed packs 10. In the case of the present example, two working stations 30 and 31 are formed. In the first working station 30, a position of the lid 13 according to FIG. 2 is produced. In the following working station 31, the lid 13 is guided back into the correct position in the pack, in accordance with FIG. 3.

In the working station 30, conveying elements come into effect, which elements grasp the laterally directed, i.e. exposed, lid side tabs 27 and move them on in a relative manner in the conveying direction, i.e. at a speed of movement which is higher than the conveying speed of the packs 10. This produces the relative displacement shown in FIG. 3. For this purpose, upper and lower conveying rollers are arranged on each side of the packs 10. A lower conveying roller is designed as a segmental wheel 32 having a radially protruding segment 33. The latter comes into contact against the lower side of the lid side tab 27 on the basis of appropriate control of the movement. A mating roller 34 interacts with the segmental wheel 32. Said mating roller is positioned above the path of movement of the lid side tabs 27. The mating roller 34 and segment 33 briefly grasp the lid side tab 27 and displace the latter in the conveying direction on the basis of appropriate speeds of rotation.

Figures 3, 4, 5:
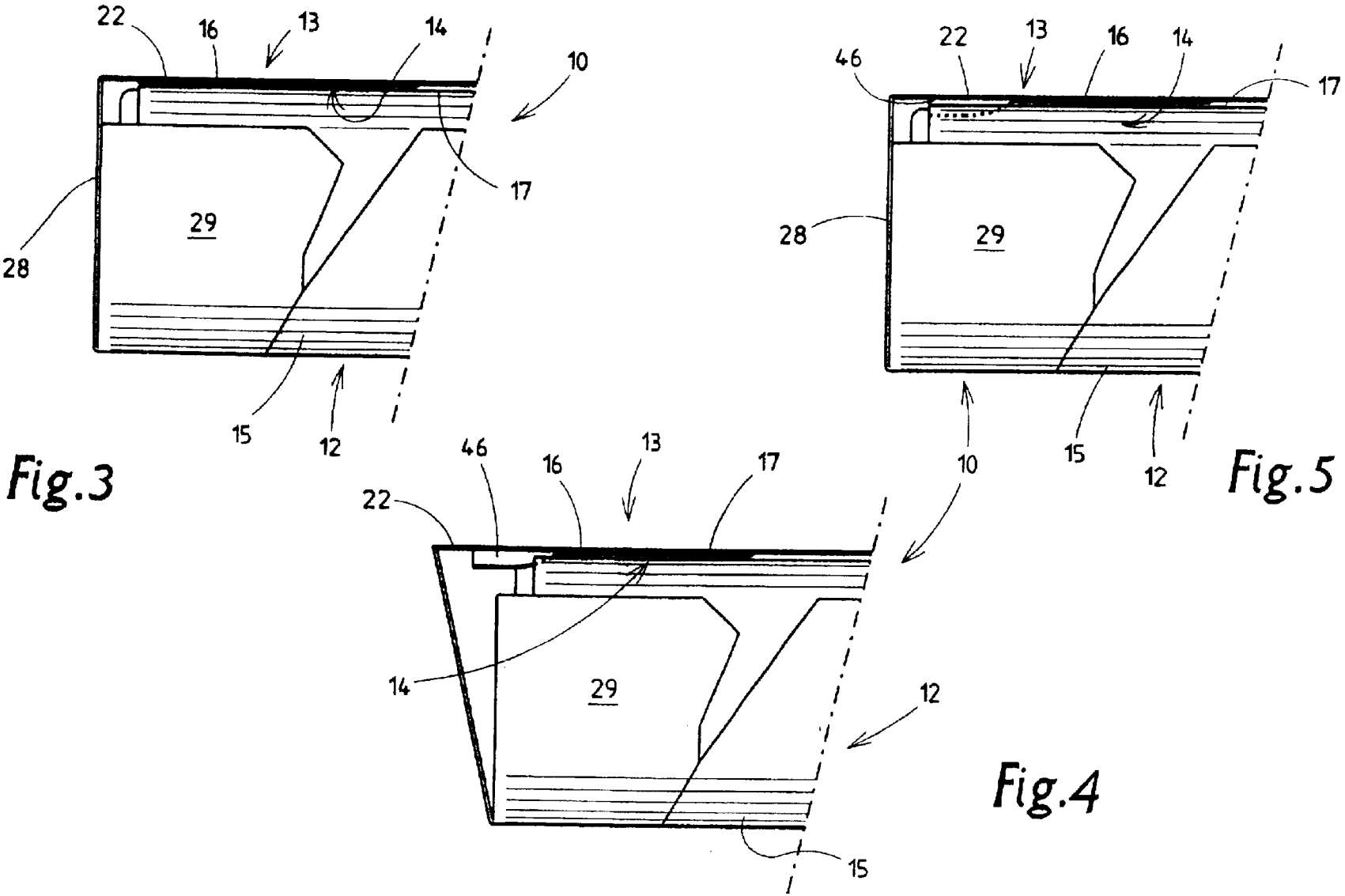
FIG. 3 to FIG. 5 show an upper, lid-side region of a hinge-lid box in various positions.
Figure 6:
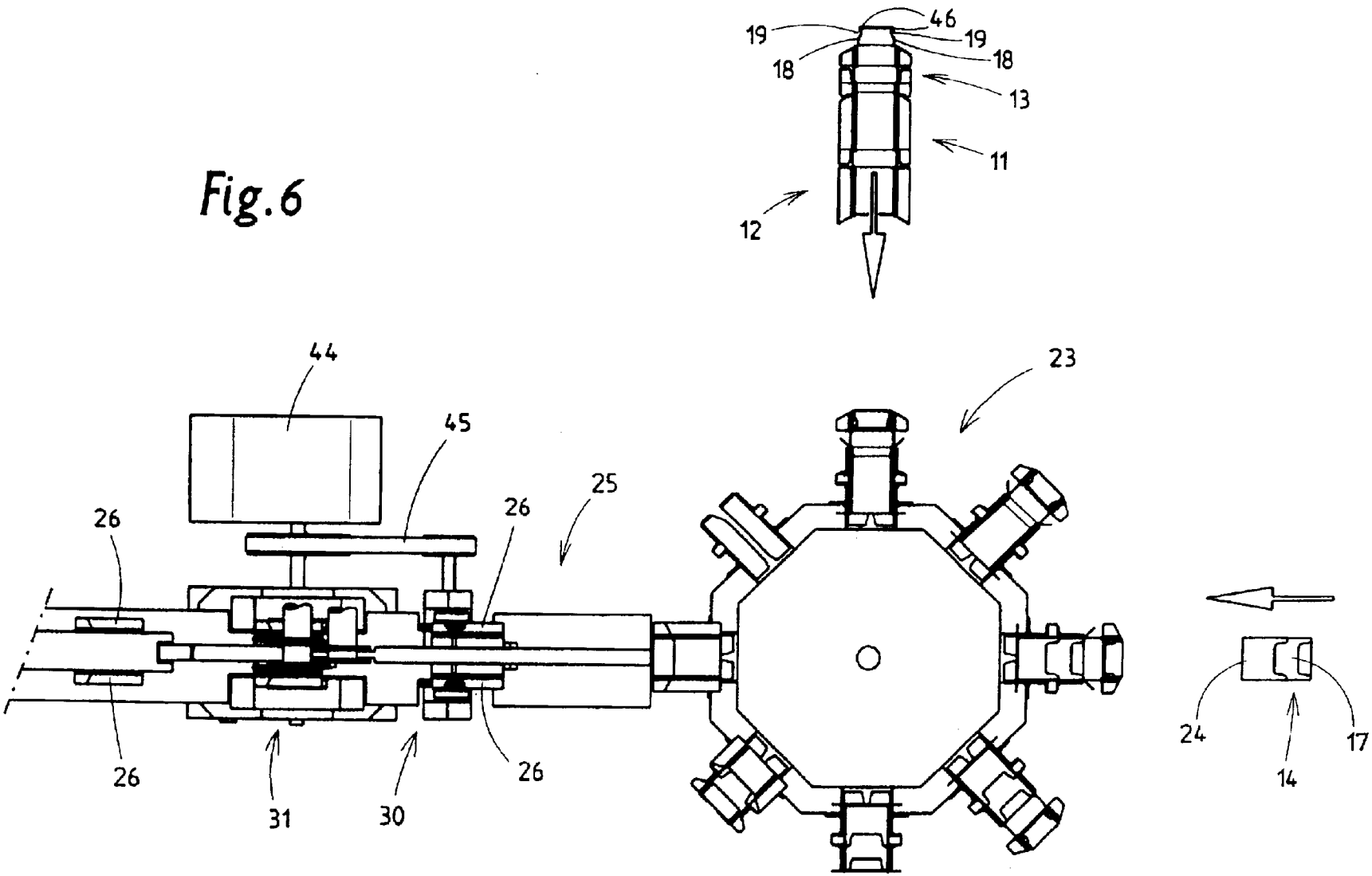
FIG. 6 shows, in a simplified plan view, a device for producing hinge-lid boxes.
Figure 7:
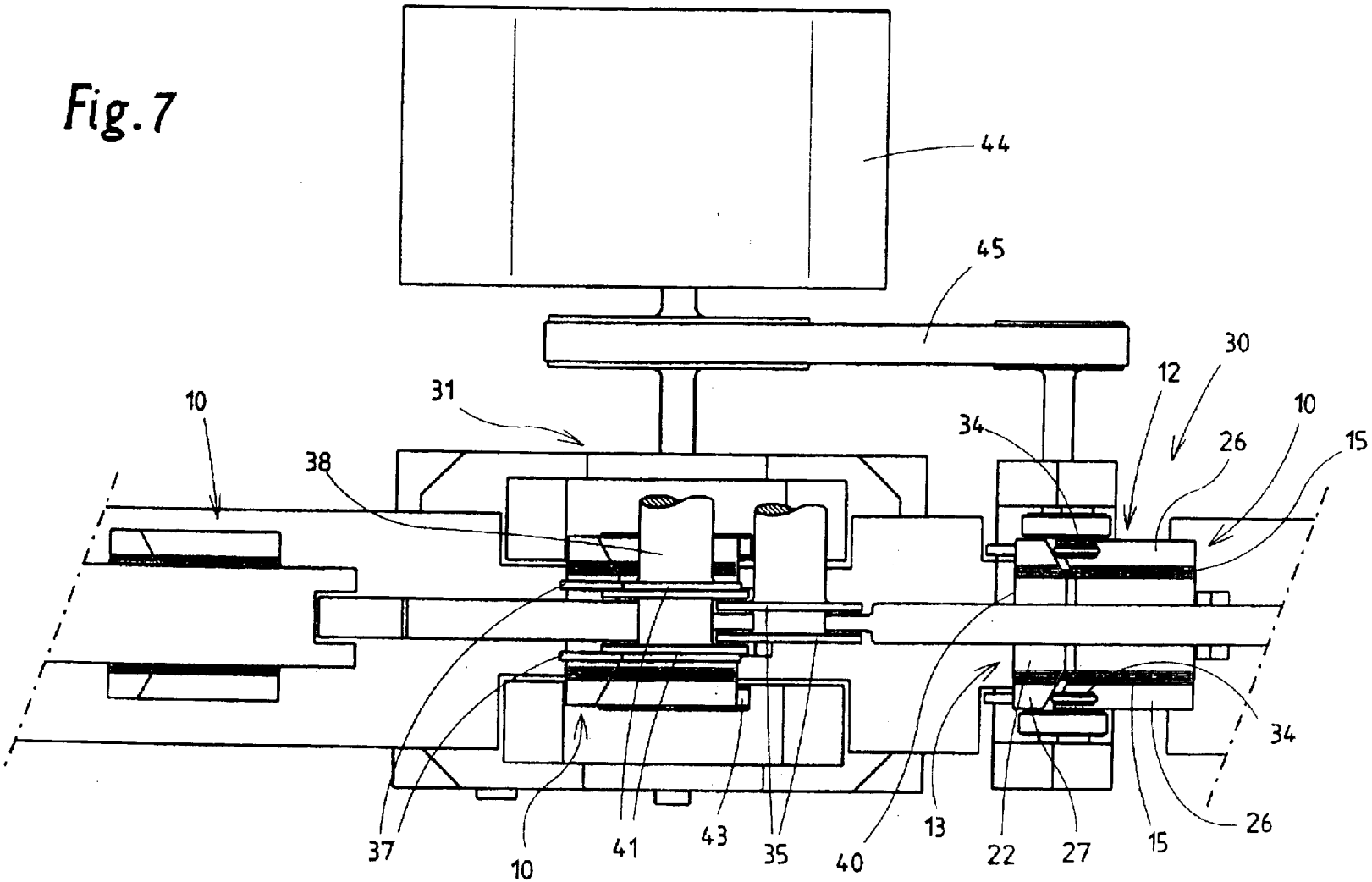
FIG. 7 shows, on an enlarged scale, a detail of the device according to FIG. 6, namely a section of a pack conveyor path.
Figure 8:
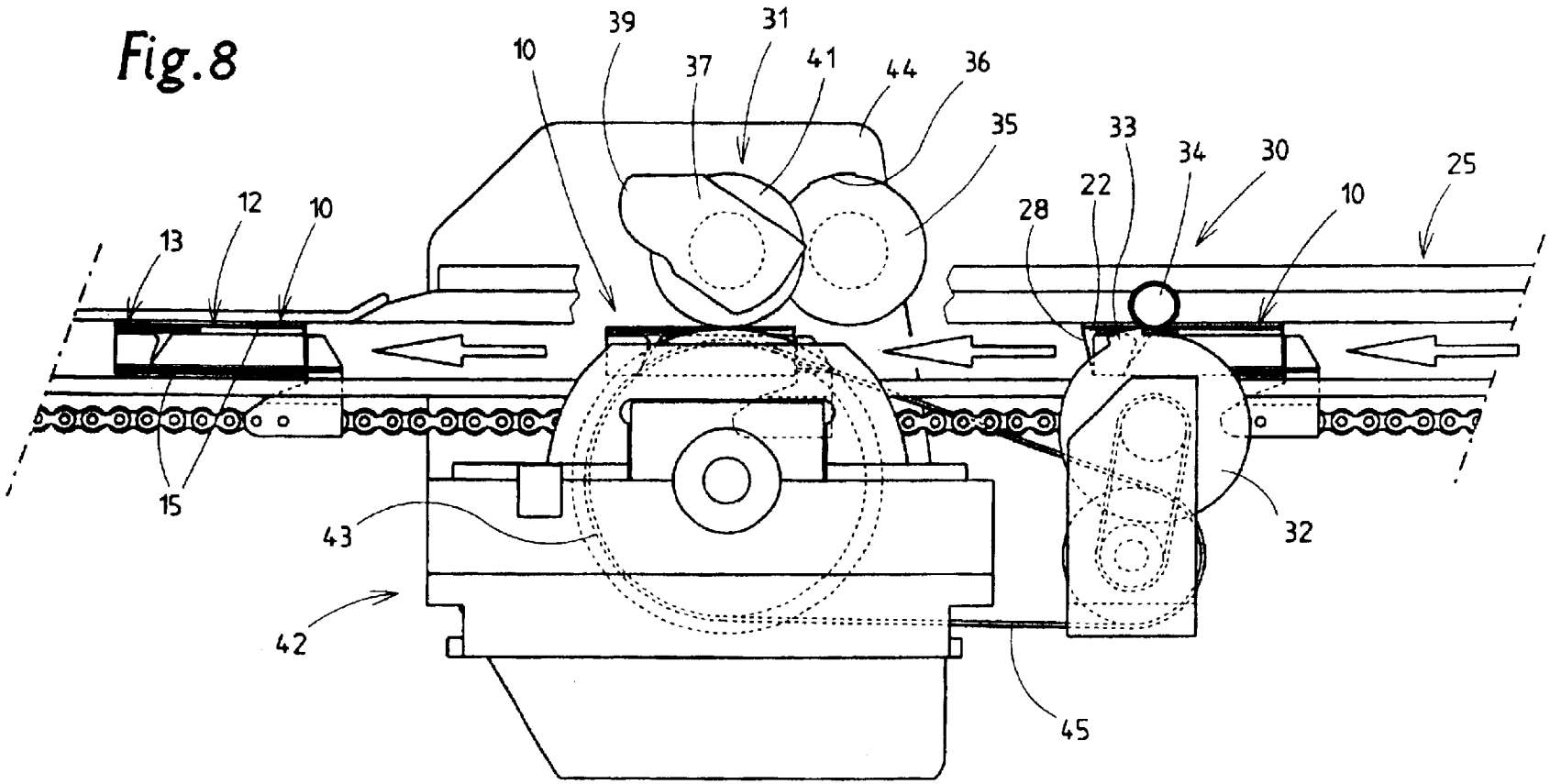
FIG. 8 shows the detail according to FIG. 7 in side view.
Figure 9:
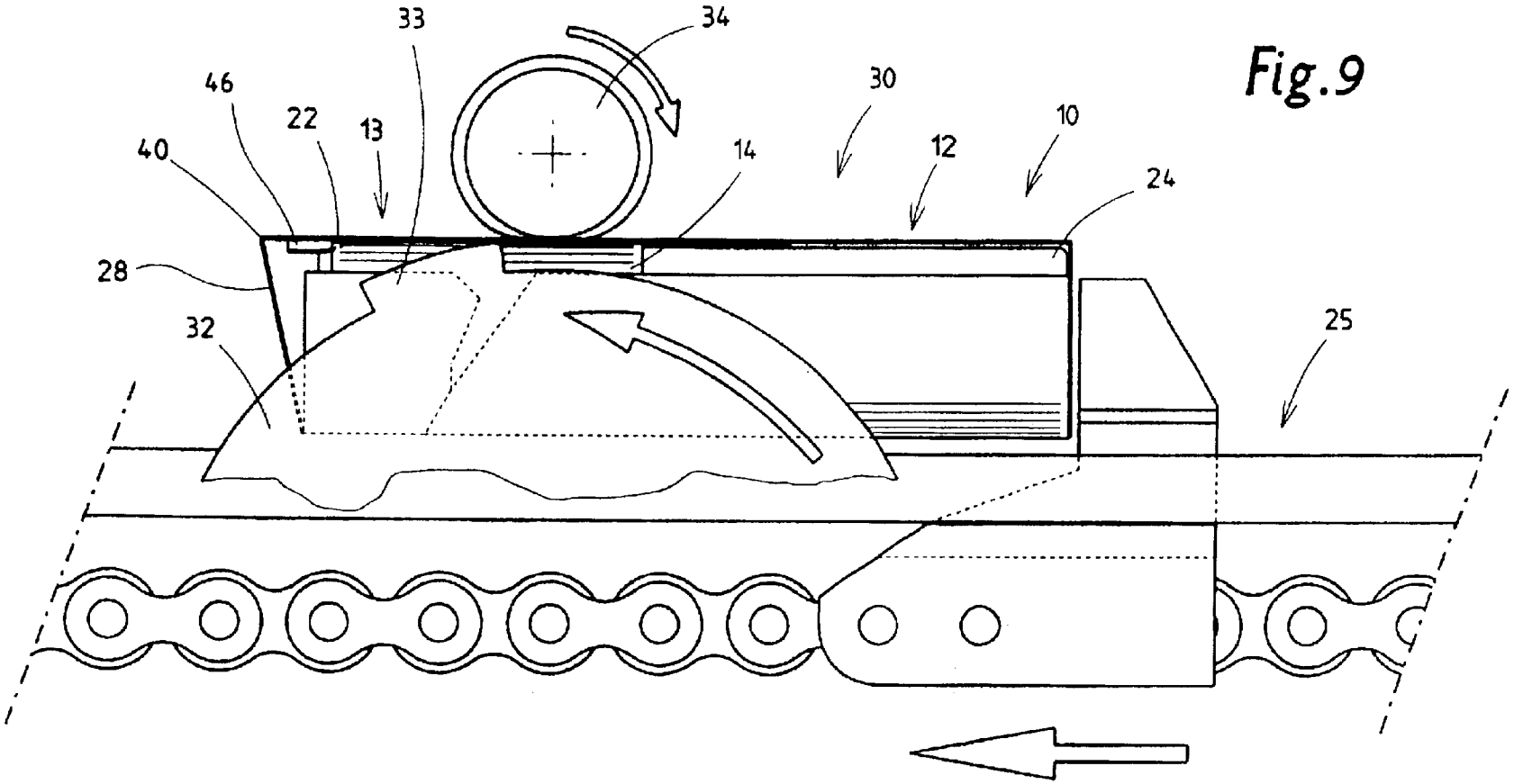
FIG. 9 shows a detail of the device according to FIG. 7 and FIG. 8, again on an enlarged scale in side view.
Figure 10:
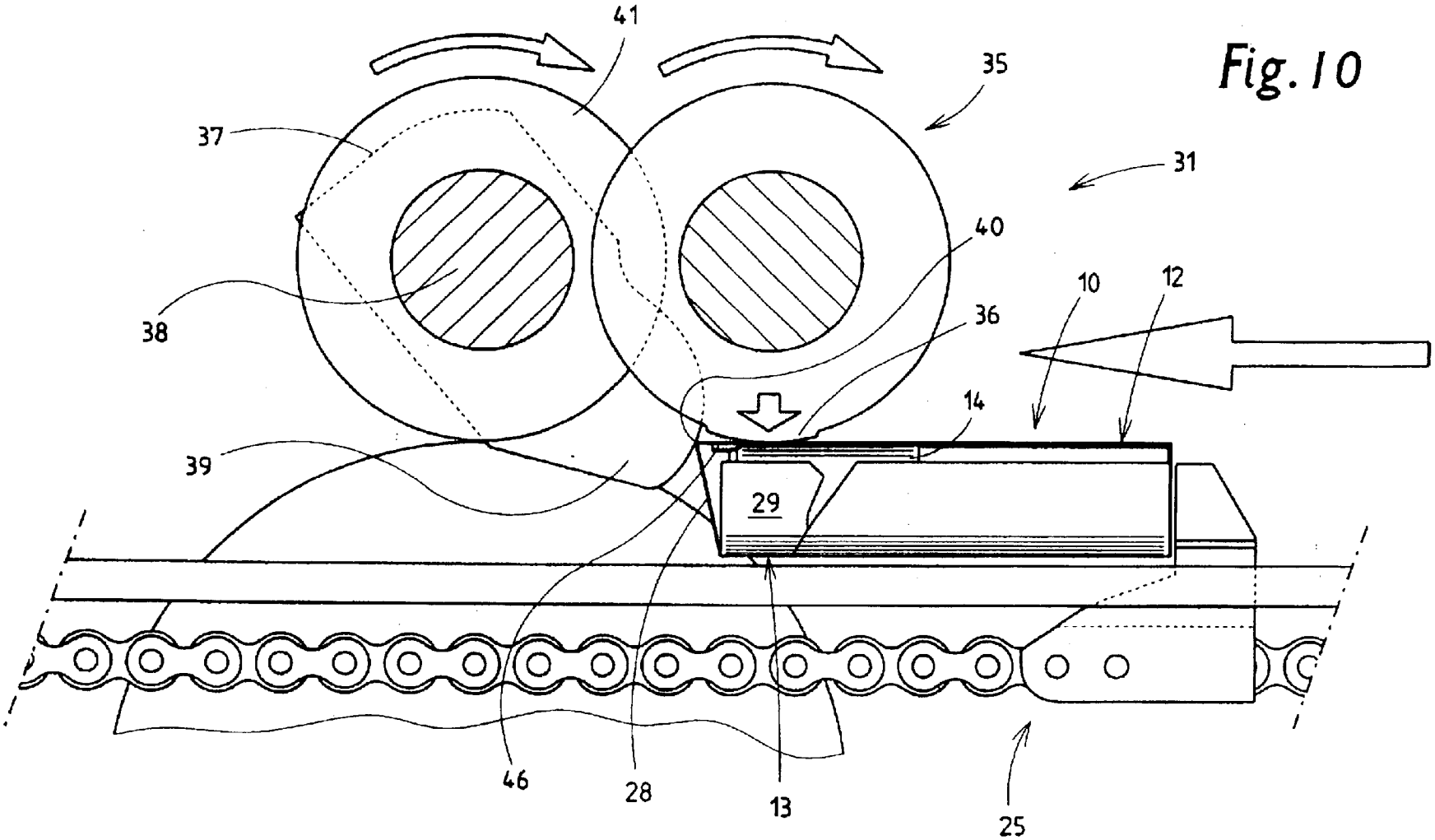
FIG. 10 shows another element of the device according to FIG. 7 and FIG. 8 in an illustration similar to FIG. 9.

The working station 31 positioned at a distance from the working station 30 comprises a plurality of elements. The latter transmit a pushing or pressure effect to the lid 13 in such a manner that the latter passes into the position according to FIG. 3. The relevant elements are positioned here in the central region of the pack 10, i.e. in the region of the lid front wall 22 (FIG. 5).

A first pressure element in the conveying direction comprises two rotatingly driven wheels 35 which are arranged at a distance from each other. Said wheels are respectively provided on the circumference with a pressure segment 36 which, on the basis of a controlled movement, obtains contact against the upwardly directed outside of the lid front wall 22 and—indirectly—of the collar front wall 17. The two wheels 35 are arranged at a relatively small, axial distance from each other in such a manner that the pressure segments 36 act in a central region of the collar front wall 17. This produces a slight raising of lateral regions of the collar front wall 17 together with the webs 21. The webs 21 are thereby brought into a favorable position for the insertion of the closure aid.

A pressure lever 37 is provided as a further element. This element causes the lid 13 to be displaced into its correct position in the pack. The pressure lever 37 is mounted on a transversely directed shaft 38, parallel to the shaft for the wheels 35. Two pressure levers 37, which are arranged at an axial distance from each other, are arranged on the shaft. On the basis of a controlled relative movement, the pressure levers obtain, by means of a rounded projection 39, contact against the end wall 28 of the lid 13 and against an edge 40 formed between the lid front wall 22 and end wall 28. By means of the slower movement of the pressure lever 37 or of the projection 39 in the conveying direction of the packs 10, the closing movement of the lid 13 is brought about with the lid inner tab 16 and collar front wall 17 simultaneously being inserted into the interlocking position.

Further rollers or wheels, namely two pressure wheels 41, which are arranged on the shaft 38, cause the lid 13 and the lid front wall 22 to be held down maintaining the interlocking position during the further movement of the packs.

The pressure wheels 41 are arranged in the region of a gluing unit 42 for the gluing of the downwardly directed sides of side tabs 26 and lid side tabs 27. The gluing unit 42 has gluing wheels 43 which are designed in a known manner, are positioned below the path of movement of the side tabs 26 and lid side tabs 27 and transfer glue onto these folding tabs.

The wheels 35, on the one hand, and the pressure wheels 41, on the other hand, are positioned in such a manner that the latter are at a greater distance from one another than the wheels 35 and the latter enter partially into the region between the pressure wheels 41. The pressure levers 37 bear against the outside of the pressure wheels 41.

After this station, the side tabs 26 and lid side tabs 27 are folded in a customary manner. The pack 10 is therefore completed, specifically with the elements of the closure aid in the engaged position.

As shown, all of the elements of the two working stations 30, 31 are moved by a common mechanism 44. The elements of the working station 30 are driven by the working station 31 via a belt 45. Provision is made for the segmental wheel 32 to be driven, but for the mating roller 34 to idle.

List of reference numerals

| | |
|---|---|
| 10 | Pack |
| 11 | Blank |
| 12 | Box part |
| 13 | Lid |
| 14 | Collar |
| 15 | Pack edge |
| 16 | Lid inner tab |
| 17 | Collar front wall |
| 18 | Side border |
| 19 | Recess |
| 20 | Depression |
| 21 | Web |
| 22 | Lid front wall |
| 23 | Folding turret |
| 24 | Cigarette block |
| 25 | Pack conveyor path |
| 26 | Side tab |
| 27 | Lid side tab |
| 28 | End wall |
| 29 | Lid side tab |
| 30 | Working station |
| 31 | Working station |
| 32 | Segmental wheel |
| 33 | Segment |
| 34 | Mating roller |
| 35 | Wheel |
| 36 | Pressure segment |
| 37 | Pressure lever |
| 38 | Shaft |
| 39 | Projection |
| 40 | Edge |
| 41 | Pressure wheel |
| 42 | Gluing unit |
| 43 | Gluing wheel |
| 44 | Mechanism |
| 45 | Belt |
| 46 | Clamping lug |

What is claimed is:

1. A method for producing cigarette packs (10), of the hinge-lid box type, each of which comprises a box part (12), a lid (13) and a collar (14), the lid (13) being retained in a closed position by a closure aid by mutual interlocking of one interlocking element of the lid (13) with one interlocking element of the collar (14), wherein the interlocking elements of the lid (13) and of the collar (14), which are disconnected from each other during production of a pack (10), are brought into an interlocking position, corresponding to an effective position of the closure aid, before the pack (10) is completed, said method further comprising the steps of:

a) initially completing the pack (10) to an extent that a lid front wall (22) of the lid (13), in the closed position, abuts a collar front wall (17) with no mutual engagement at the collar front wall (17), b) then, displacing the lid front wall (22) in an opening direction of the lid (13) such that the interlocking elements lie offset to one another, and c) finally, displacing the lid front wall (22) back into the closed position of the lid (13) as the interlocking element of the lid is guided into the interlocking position with the interlocking element of the collar before the pack is completed.

2. The method according to claim 1, wherein the closure aid is formed as the interlocking element on the lid by a lid inner tab (16) with recesses (19) in a region of side borders (18), and as the interlocking element on the collar by webs (21) for delimiting a depression (20) of the collar front wall (17), said interlocking position being made by the steps of:

a) first, finalizing the pack (10) up to a point that the lid inner tab (16) abuts the collar front wall (17) in the closed position of the lid (13), b) then displacing the lid front wall (22) with lid inner tabs (16) in the opening direction of the lid (13) and relative to the collar front wall (17) such that the recesses (19) lie offset to the webs (21), and c) to achieve interlocking engagement of the interlocking elements, displacing the lid front wall (22) back to its initial, closed position, as the webs (21) are introduced into associated ones of the recesses (19).

3. The method according to claim 2, further comprising the step of, during the displacement of the lid front wall (22) to the closed, or interlocking, position with the webs (21) of the collar (14), exerting pressure at least temporarily on the lid front wall (22) in a region of the interlocking elements.

4. The method according to claim 2, further comprising the step of connecting outer lid side tabs (27), connected to the lid front wall, and inner lid side tabs (29) to each other by adhesive bonding after the lid inner tab (16) and the collar front wall (17) have been guided into the interlocking position.

5. A device for producing cigarette packs (10), of the hinge-lid box type, each of which comprises a box part (12), a lid (13) and a collar (14), the lid (13) being retained in a closed position by a closure aid, comprised of mutually interlocking elements, by a mating of a lid inner tab (16), on an inner side of a lid front wall (22), with a collar front wall (17) of the collar (14), said device comprising:

a) means for transporting in a transport direction each pack (10), which is largely completed by folding of a blank (11), along a pack conveyor path (25) with the lid front wall (22) facing upwards and abutting the collar front wall (17), and b) positioned above the pack conveyor path (25), an element for, during production of a pack and prior to completion thereof, producing a displacement of the lid front wall (22), in the direction of an open position of the lid (13) relative to the collar front wall (17), and then producing a counter-displacement of the lid front wall (22) back to its initial, or said closed, position.

6. The device according to claim 5, a) wherein said means for transporting also transports the packs (10), in a region of the pack conveyor path (25), with outer lid side tabs (27) directed laterally in a plane of the lid front wall (22), said device further comprising b) actuating member means, arranged above the pack conveyor path of the packs (10), for, first, moving the lid front wall (22) back from the box part (12), and, then, pushing the lid front wall (22) back to said initial, or closed, position.

7. The device according to claim 6, further comprising elements for displacing the lid front wall (20) in the opening direction of the lid (13), said elements comprising a segmental wheel (32) and a mating roller (34), said elements being arranged above the pack conveyor path of the packs (10) in a first work station (30) in the transport direction of the packs (10), and said elements gripping the laterally directed, outer lid side tabs (27) of each lid, and displacing said side tabs along with the lid front wall (22).

8. The device according to claim 7, further comprising means for gripping the lid side tabs (27) between the segmental wheel (32) or a segment (33) of the segmental wheel (32), on one hand, and a mating roller (34) arranged above the path of movement on the other hand, the segmental wheel (32) and mating roller (34) being rotatable in a conveying direction relative to the packs (10) such that the side tabs (27) are displaced with the lid front wall (22) in the opening direction of the lid (13).

9. The device according to claim 7, wherein the first work station (30) is followed in the conveying direction of the packs (10) by a second work station (31) which has a push element for moving the lid (13) or the lid front wall (22) back to its initial, or closed, position as the interlocking elements are guided into the interlocking position.

10. The device according to claim 9, wherein the push element comprises a pressure lever (37), which revolves in a rotating manner and which temporarily abuts against the lid (13) by means of a projection (39), namely, against an end wall (28) which faces forwards in the direction of transport, or against an edge (40) formed between the lid front wall (22) and end wall (28).

11. The device according to claim 5, further comprising means for applying pressure, during a return movement of the lid front wall (22) to its closed position, at least temporarily to the lid front wall (22) in a region of the interlocking elements, namely in a region of border edges of the lid inner tab (16).

12. The device according to claim 11, wherein the means, for applying pressure to the lid front wall (22), comprises two rotating wheels (35) which are arranged at a transverse distance from each other and which have pressure segments (36).

13. The device according to claim 9, further comprising means for applying pressure, during a return movement of the lid front wall (22) to its closed position, continuously or predominantly on the lid front wall (22) in a region of a pressure lever (37) by means of rotary pressure wheels (41) mounted on a common same axis for the purpose of holding down the lid front wall (22).

14. A method for producing cigarette packs (10), of the hinge-lid box type, each of which comprises a box part (12), a lid (13) and a collar (14), the lid (13) being retained in a closed position thereof by a closure aid providing mutual interlocking of interlocking elements comprising folding tabs of the lid (13) on one hand, and the walls of the collar (14) on the other hand, wherein the interlocking elements, which are disconnected from each other during production of each pack (10), are brought into an interlocking position corresponding to an effective position of the closure aid before the pack (10) is completed, said method further comprising the steps of:

a) initially completing the pack (10) to an extent that a lid front wall (22) of the lid (13), in the closed position of the pack (10), abuts a collar front wall (17) with no mutual engagement at the collar front wall (17), b) then, displacing the lid front wall (22) in an opening direction of the lid (13) such that the interlocking elements of the lid (13) and collar (14) lie offset to one another, and c) finally, displacing the lid front wall (22) back into the closed position of the lid (13) as the interlocking members are guided into the interlocking position.

15. A method for producing cigarette packs (10), of the hinge-lid box type, each of which comprises a box part (12), a lid (13) and a collar (14), the lid (13) being retained in a closed position thereof by a closure aid comprising a lid inner tab (16), which is attached to an inner side of the lid front wall (22) and which has recesses (19) in a region of side borders (18) as an interlocking element on a side of the lid, and by webs (21) for delimiting a depression (20) of a collar front wall (17) as an interlocking element on a side of the collar, wherein the interlocking elements, the lid inner tab (16) and the collar front wall (17), which are disconnected from each other during production of the pack (10), are brought into an interlocking position corresponding to an effective position of the closure aid before the pack (10) is completed, said method further comprising the steps of:

a) first, finishing the pack (10) up to a point that the lid inner tab (16) abuts the collar front wall (17) in the closed position of the lid (13) with no engagement of the recesses (19) and the webs (21), b) then, displacing the lid front wall (22) with lid inner tab (16) in an opening direction of the lid (13) and relative to the collar front wall (17) such that the recesses (19) lie offset to the webs (19), and c) to achieve interlocking engagement, displacing the lid front wall (22) back to its closed position, as the webs (21) are introduced into associated ones of the recesses (19).

16. A method for producing cigarette packs (10), of the hinge-lid box type, each of which comprises a box part (12), a lid (13) and a collar (14), the lid (13) being retained in a closed position thereof by a closure aid providing mutual interlocking of interlocking elements comprising folding tabs of the lid (13), on one hand, and the walls of the collar (14) on the other hand, wherein the interlocking elements, which are disconnected from each other during production of the pack (10), are brought into an interlocking position corresponding to an effective position of the closure aid before the pack (10) is completed, said method further comprising the steps of:

a) initially completing the pack (10) to an extent that outer lid side tabs (27) in a region of the closed lid (13) are folded into a plane of a lid front wall (22), and that the lid front wall (22), in a closed position of the pack (10), abuts a collar front wall (17) with no mutual engagement of the interlocking elements, b) then, displacing the lid front wall (22) in an opening direction of the lid (13) such that the interlocking elements of the lid (13) and collar (14) lie offset to one another, c) displacing the lid front wall (22) back into the closed position of the lid (13) as the interlocking elements are guided into the interlocking position, and d) then, folding the lid side tabs (27), which are provided with glue, to form lid side walls.

* * * * *